United States Patent [19]

Taniguchi et al.

[11] Patent Number: 4,687,313

[45] Date of Patent: Aug. 18, 1987

[54] APPARATUS FOR PROCESSING SENSITIVE MATERIALS

[75] Inventors: Hiroshi Taniguchi; Mitsumasa Tanizawa; Masatoshi Ueno, all of Kyoto, Japan

[73] Assignee: Dainippon Screen Mfg. Co., Ltd., Japan

[21] Appl. No.: 847,519

[22] Filed: Apr. 3, 1986

[30] Foreign Application Priority Data

Apr. 30, 1985 [JP] Japan ..... 60-94372

[51] Int. Cl.[4] ..... G03D 3/02; G03D 3/08

[52] U.S. Cl. ..... 354/320; 354/324; 134/64 P

[58] Field of Search ..... 354/316, 320, 321, 322, 354/324; 134/64 P

[56] References Cited

U.S. PATENT DOCUMENTS 3,662,660 5/1972 Layne ..... 354/320
3,922,702 11/1975 Gaskell ..... 354/324
4,125,851 11/1978 Krehbiel ..... 354/321
4,291,969 9/1981 Raymond ..... 354/322

FOREIGN PATENT DOCUMENTS 58-135743 9/1983 Japan .
1270161 4/1972 United Kingdom ..... 354/320

*Primary Examiner*—A. A. Mathews
*Attorney, Agent, or Firm*—Lowe Price LeBlanc Becker & Shur

[57] ABSTRACT

An apparatus for processing sensitive materials has a tank in which film containing a sensitive material is conveyed, the film passing through a processing bath while guided by conveying rollers, and at least one wiper coming into contact with at least one of the conveying rollers facing to a film surface of the sensitive material. A flow of processing solution is produced by at least one inlet or jet in the region where contact occurs between a wiper and a conveying roller, so that any material wiped off the roller is removed away from the contacting region.

5 Claims, 3 Drawing Figures

APPARATUS FOR PROCESSING SENSITIVE MATERIALS

BACKGROUND OF THE INVENTION

1. Field of the Invention

This invention relates to an apparatus for processing sensitive materials in which sensitive material such as exposed film is conveyed through a vessel filled with a processing solution by a plurality of conveying rollers, to be subjected to the processing, and more particularly to an apparatus for processing sensitive materials in which the conveying rollers are kept free of any sticky materials that may tend to attach to the roller surfaces.

2. Description of Prior Art

In the processing of a sensitive material, such as in a process for developing a film, it is often the case that when halogenated silver particles having a latent image core on a film surface are converted to metal silver by chemical reaction a part thereof separates from the film surface and sticks to the surfaces of conveying rollers, thereby causing a so-called silver stain. As the amount of such metal silver stuck to the surfaces of conveying rollers is gradually increased, the silver is transferred from the surfaces of conveying rollers to the film conveyed by the rollers, resulting in the film being stained.

Furthermore, in a film-washing process, it is often the case that the surfaces of conveying rollers are stained by deposits and/or gelatin on the film surface, and this adversely affects the film conveying process.

In order to overcome such problems, it is necessary for a large number of conveying rollers together with a side plate on which the conveying rollers are supported to be frequently taken out of the processing solution for cleaning. Such taking out and cleaning is not easy, particularly in the case of a large-sized processing apparatus.

In order to solve the foregoing problem, an apparatus has been already proposed by the applicant, as disclosed in Japanese Utility Model Publication (unexamined) Sho 58-135743, wherein conveying rollers are automatically cleaned by washing rollers which are pressed on the conveying rollers and rotated so that their contact surfaces on one side are opposite to one another. This known apparatus is indeed useful for cleaning the rollers, but the processing unit becomes complicated in its entirety, and moreover it is troublesome to clean these washing rollers which themselves become stained in cleaning the conveying rollers.

Another apparatus for reducing the sticking of silver transferred from the conveyer roller surfaces, by forming spiral grooves on the conveying rollers, has been also conventionally used. But this apparatus is not very useful when carrying out processing over a long period of time.

SUMMARY OF THE INVENTION

Accordingly, it is an object of this invention to provide a novel apparatus for processing sensitive materials in which a film containing sensitive material is conveyed by passing the same through a tank filled with processing solution by a plurality of conveying rollers, characterized by comprising at least one wiper in contact with the outside of at least one of the conveying rollers facing the film surface of the sensitive material, and means for producing flows near the area of contact between the conveying roller and the wipers.

By the foregoing arrangement, it is possible to ensure that silver stain, deposits, gelatin, and the like that stick to the conveying rollers are removed by the wiper, and also that accumulation of such stains is successfully prevented by producing a flow near the contact area between the wiper and the conveying rollers.

Other objects and features of this invention will become apparent in the course of the following description of the preferred embodiments together with the accompanying drawings.

DESCRIPTION OF THE PREFERRED EMBODIMENT

An embodiment wherein this invention is applied to a developing tank of an automatic film developing machine is described in detail hereinafter.

Figure 3:
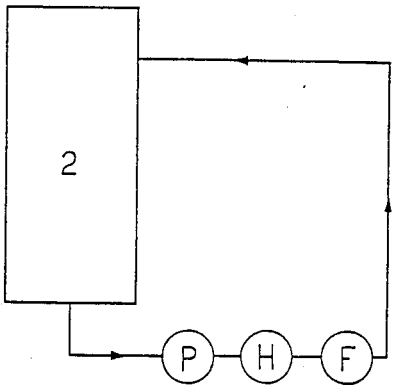
FIG. 3 is a schematic view illustrating the path of circulation of processing solution.

Referring to FIG. 3 illustrating the a circulation of processing solution, the processing solution discharged from a developing tank 2 circulates by passing through a pump P, a heater H, a filter F and returning to the developing tank 2.

Figure 1:
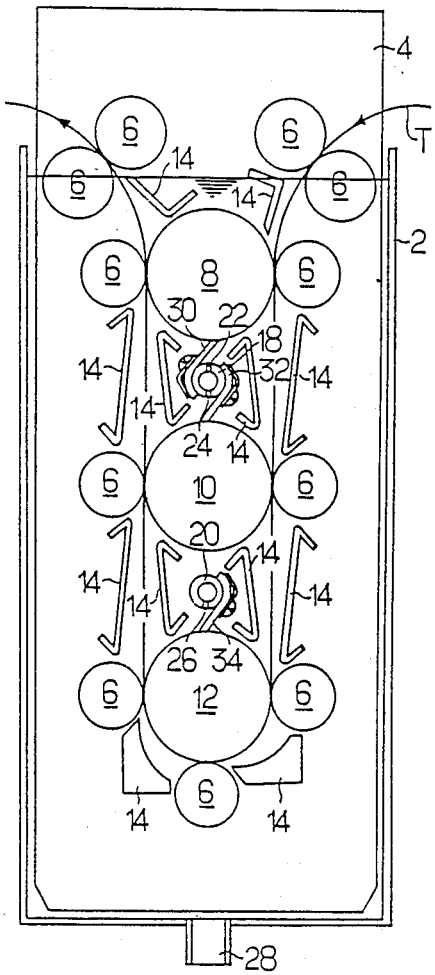
FIG. 1 and FIG. 2 are sectional views of an embodiment of the apparatus in accordance with this invention.

Referring to FIG. 1 showing a sectional view of the developing tank 2, a film to be processed is conveyed along the film conveying path (T) through the developing solution by a plurality of rollers 6, 8, 10, 12 supported on a side plate 4 with its film face opposed to the conveying rollers 8, 10, 12. Numeral 14 is a guide of the film to be processed.

Numerals 18,20 are spray tubes communicating with the filter F shown in FIG. 3, and these spray tubes are provided with jets 22, 24, 26 for injecting the processing solution into the developing tank (2). These jets 22, 24, 26 can be provided in large number along the spray tubes 18,20 otherwise formed into slits along the spray tubes. Numeral 28 is an outlet for discharging the processing solution out of the developing tank 2, and this outlet 28 communicates with the pump P shown in FIG. 3.

Numerals 30, 32, 34 are wipers fitted to the spray tubes 18, 20, and one end of each wiper comes in contact with each conveying roller 18, 10, 12. These wipers 30, 32, 34 are composed of material such as rubber or sponge so as not to cause damage to the conveying rollers 8, 10, 12. During developing of a film with the foregoing apparatus, the silver stain will occur particularly on the surfaces of the conveying rollers 8, 10, 12 facing to the film. The silver stain, however, is wiped (or scratched) off by the wipers 30, 32, 34 and dispersed into the processing solution ejected through the solution jets 22, 24 26 without accumulating in front of the wipers 30, 32, 34.

The wiped-off silver stain material dispersed into the processing solution flows into the filter F by way of the pump P and the heater H through an inlet (28), and is removed from the processing solution by the filter F. The processing solution from which the silver stain has been removed is injected again from the jets 22, 24, 26 to the developing tank 2.

Figure 2:
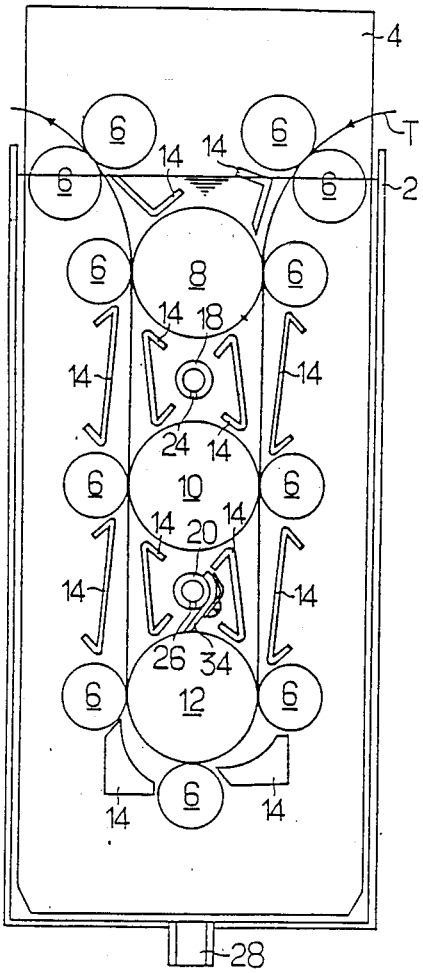

Referring now to FIG. 2 showing another embodiment of this invention, wherein only the single wiper 34 is fitted for making contact with the conveying roller 12 that contacts the portion of the film making a U-turn. Since the silver stain is most likely to be produced particularly on the conveying roller 12 at the U-turn portion of the film, a siderable roller-cleaning effect is attained by contact only between the single wiper 34 and the conveying roller 12.

However, in order to sufficiently protect such liquid tanks as fixing tank, washing tank, etc. other than the developing tank 2 from stains by deposit, gelatin, etc. other than the silver stain, it is preferred that the wipers contact all of the rollers facing to the film. It may also be advantageous to bring the wipers into contact with rollers other than those facing to the film.

In the foregoing embodiments the processing solution is injected from the processing solution jets 22, 24, 26 toward to the contact areas between the conveying rollers 8, 10, 12 and the wipers 30, 32, 34. It is also possible to convert the jets 22, 24, 26, shown in the embodiments of both FIGS. 1 and 2, to inlets for inducing the processing solution and the inlet 28 to a jet for injecting the processing solution. In such a modification of the embodiment of FIG. 1, the stains such as silver stain accumulated in front of the wipers 30, 32, 34 are sucked through into the inlets 22, 24, 26 together with the processing solution and removed from the solution by the filter F, and the filtered processing solution is injected through the jet 28 to the processing solution tank 2 by way of the heater H and the pump P.

In this manner, according to this invention, there is provided an apparatus for processing sensitive materials comprising at least one wiper which comes into contact with at least one of the conveying rollers facing to a film surface of the sensitive material and means for producing a flow near the contact area between the conveying roller and the wiper, and as a result following advantages are attained:

(1) It is possible to omit troublesome work such as taking out side plates on which plural conveying rollers are supported out of the processing solution tank to clean the rollers.

(2) Since the side plates with the rollers supported thereon are not required to be taken out of the processing solution tank, the body of the processing apparatus and floors nearby are prevented from becoming contaminated by the processing solution.

(3) Since the conveying rollers are cleaned during the processing operation of the sensitive material, it is not necessary to stop the operation of the processing apparatus for the purpose of cleaning, and as a result the productivity of the apparatus is improved.

As many apparrently different embodiments of this invention may be made without departing from the spirit and scope thereof except, it is to be understood that this invention is not limited to the specific example thereof except as defined in the appended claims.

We claim:

1. An apparatus for processing sensitive materials in which film comprising a sensitive material is conveyed through a tank filled with processing solution, said film being guided inside said tank by a plurality of conveying rollers, characterized by comprising:

at least one wiper means coming into contact with at least one of the plurality of conveying rollers facing to a film surface of the sensitive material for wiping said contacted roller, and;

means for producing a directed flow of processing solution through the region of contact between the conveying roller and the contacting wiper means, whereby said directed flow removes away from said contacting region any material wiped from said conveying rollers by said wiper means.

2. An apparatus as claimed in claim 1, further including:

a jet communicating with and supported by said flow producing means near said region where said wiping contact occurs for delivering said flow of processing solution, said flow producing means including a filter, a heater and a pump.

3. An apparatus as claimed in claim 1, wherein said at least one roller with which said wiper comes into contact is a conveying roller corresponding to a U-turn in the passage of the film guided thereby.

4. An apparatus as claimed in claim 1, wherein said processing solution is a developer.

5. An apparatus as claimed in claim 1, wherein:

said flow producing means comprises a tube for delivering said processing solution to said jet; and said wiper means is mounted to said tube.

* * * * *